US007823880B2

(12) United States Patent
Coenen et al.

(10) Patent No.: US 7,823,880 B2
(45) Date of Patent: Nov. 2, 2010

(54) STEPPER MECHANISM

(75) Inventors: Jeroen J. G. Coenen, Sevenum (NL); Bae W. J. J. A. Van Dorp, Eindhoven (NL)

(73) Assignee: OCE-Technologies B.V., Venlo (NL)

( * ) Notice: Subject to any disclaimer, the term of this patent is extended or adjusted under 35 U.S.C. 154(b) by 208 days.

(21) Appl. No.: 11/808,197

(22) Filed: Jun. 7, 2007

(65) Prior Publication Data

US 2008/0251986 A1 Oct. 16, 2008

(30) Foreign Application Priority Data

Jun. 8, 2006 (EP) ..... 06115164

(51) Int. Cl.
*B65H 5/12* (2006.01)

(52) U.S. Cl. ..... 271/267; 271/84; 271/227

(58) Field of Classification Search ..... 271/267, 271/268, 84, 227, 230, 231
See application file for complete search history.

(56) References Cited

U.S. PATENT DOCUMENTS

| | | | | |
|---|---|---|---|---|
| 2,923,235 | A * | 2/1960 | Voegelin | 101/407.1 |
| 3,717,249 | A * | 2/1973 | Faley | 209/552 |
| 5,065,638 | A * | 11/1991 | Barens | 74/351 |
| 5,207,413 | A * | 5/1993 | Maron | 271/5 |
| 5,216,442 | A * | 6/1993 | Parks et al. | 346/134 |
| 6,152,444 | A * | 11/2000 | Elgee et al. | 271/266 |
| 6,572,292 | B2 * | 6/2003 | Kelley et al. | 400/627 |
| 7,093,931 | B2 * | 8/2006 | Ishii et al. | 347/104 |
| 7,367,668 | B2 * | 5/2008 | Ishii et al. | 347/104 |
| 2005/0012263 | A1 * | 1/2005 | Koyanagi et al. | 271/227 |

FOREIGN PATENT DOCUMENTS

| | | |
|---|---|---|
| DE | 578 936 | 6/1933 |
| JP | 6-328113 A | 11/1994 |
| WO | WO-01/56804 A1 | 8/2001 |

* cited by examiner

*Primary Examiner*—Richard W Ridley
*Assistant Examiner*—Michael C McCullough
(74) *Attorney, Agent, or Firm*—Birch Stewart Kolasch & Birch, LLP

(57) ABSTRACT

A stepper mechanism for transporting a substrate along a linear transport path, which includes a stationary member and first and second transport members, extending widthwise across the transport path, the stationary member and transport members each being adapted to alternatively grip and release the substrate, and independent drive units are arranged on either side of the transport path for moving the respective ends of the transport members in a transport direction (X), wherein the transport members are movable independently of one another, and at least one of the drive units is adapted to move one end of the first transport member independently of the corresponding end of the second transport member.

8 Claims, 6 Drawing Sheets

STEPPER MECHANISM

CROSS-REFERENCE TO RELATED APPLICATION

This application claims priority from European Patent Application No. 06115164.3 filed on Jun. 8, 2006, the entire contents of which is hereby incorporated by reference in its entirety.

BACKGROUND OF THE INVENTION

1. Field of the Invention

The present invention relates to a stepper mechanism for transporting a substrate along a linear transport path, comprising a stationary member and first and second transport members extending widthwise across the transport path, said stationary member and transport members each being adapted to alternatingly grip and release the substrate, and independent drive units arranged on either side of the transport path for moving the respective ends of the transport members in a transport direction.

2. Description of Background Art

A stepper mechanism of this kind may be used, for example, for transporting print substrates in the form of separate sheets or endless webs through a printer, e.g. over a print surface of an ink jet printer.

In comparison with roller-type transport mechanisms for print substrates, wherein the substrate is passed through a nip between two rollers, a stepper mechanism has the advantage that it is intrinsically less prone to micro-slip and is not affected by inaccuracies resulting from the geometry and/or eccentricity of a transport roller, and the like, so that a very high step accuracy can be achieved. Moreover, since the stepper mechanism may be arranged to engage the substrate only from one side, preferably the side opposite to the side on which an image is printed, it is capable of handling a large variety of different types of substrates having different thickness and being made of different materials including both flexible and rigid materials, without affecting the image that is being printed or has just been printed on the substrate.

Since the drive systems arranged on opposite sides of the transport path are independent from one another, a possible misalignment of the substrate may be corrected by providing different step widths for the left and right sides of the substrate.

A known stepper mechanism of the type described above has been disclosed in Research Disclosure 36449, published in August 1994. In this mechanism, the two transport members are rigidly connected to one another, so that they form a rectangular frame which encloses the stationary member with sufficient space available in the transport direction, so that the frame may be moved relative to the stationary member.

SUMMARY OF THE INVENTION

It is an object of the present invention to provide a stepper mechanism with improved capabilities for correcting the position of the substrate, especially for substrates in sheet form.

In order to achieve this object, a stepper mechanism of the type described above is provided with transport members which are movable independently of one another, and at least one of the drive units is adapted to move one end of the first transport member independently of the corresponding end of the second transport member.

When separate substrate sheets are fed successively into the stepper mechanism, the individual sheets may be supplied in somewhat inclined positions, so that their lateral edges are not exactly parallel to the transport direction. As is known in the art, this inclination can be corrected by providing different step widths for the left and right ends of the transport member gripping the sheet, so that the sheet is subjected to a rotation about a Z-axis normal to the plane of the transport path. In a situation where a trailing part of a first sheet is still being gripped by the second transport member while a leading part of a subsequent sheet is being gripped for the first time by the first transport member, the present invention provides the possibility to rotate or "steer" the two sheets independently of one another. In particular, the first transport member may be rotated so as to correct the inclination of the subsequent sheet, whereas the first sheet, the inclination of which had already been corrected earlier, is not rotated and continues to move straight in the direction of the transport path.

Similarly, when the substrate is in the form of a web, e.g., a web that is drawn-off from a roll, the longitudinal direction of the web may deviate from the transport direction, due to tolerances in the suspension of the roll and/or in the feed mechanism with which the web is introduced into the stepper mechanism. Since the stepper mechanism feeds the web exactly in the transport direction, the left and right margins of the web in the portion on and directly upstream of the stepper mechanism will then be subject to different tensile forces, and if the web material has a certain elasticity, the web will be stretched on the side where the tensile forces are larger, and this may result in a distortion of the printed image. In the mechanism according to the present invention, the first transport member may be rotated such that the tensile forces in the web are balanced again when the web is gripped by the stationary member, so that no distortion of the web will occur on the stationary member and downstream thereof.

The stationary member and the transport members must be capable of gripping and releasing the substrate, preferably only from the bottom side, when the top surface of the substrate is being printed on. This may be achieved in various ways, for example by means of a switched vacuum pressure, switched electrostatic attraction or switched adhesion (e.g., by providing the top surfaces of the members with an adhesive layer the adhesive properties of which depend on the presence of an electrostatic field or the like). The substrate may also be gripped by mechanical clamps. Such mechanical clamping will preferably be used in addition to, e.g., suction pressure in the case of substrates having a relatively high mass of inertia.

In a printer, the stepper mechanism may be provided on the upstream side or the downstream side of a print surface where the image is printed, e.g. by means of ink jet printheads arranged on a carriage that moves across the transport path. In order to permit full-bleed printing, a stepper mechanism according to the present invention may be provided on both, the upstream side and the downstream side of the print surface, or the print surface may be formed by the stationary member of the stepper mechanism. The stepper mechanism may also be integrated in the print surface. However, for certain types of printers, e.g., ink jet printers, it is advantageous that the print surface is perfectly flat. Then, it may be even more advantageous that the top surfaces of the stationary members and the transport members are exactly flush with each other, at least in the state in which the substrate is held at rest and the printhead is operating.

On the other hand, the stationary member and/or the transport members may be adapted to be lifted when they grip the substrate, and lowered when they release the same, in order to reduce the frictional resistance when the substrate is moved. As an alternative, friction may be reduced by creating an air cushion over which the substrate may slide. This option is particularly convenient in combination with a vacuum system for gripping the substrate by sucking the same against the stationary member and the transport members, respectively.

When the substrate takes the form of successive sheets, the stepper mechanism should be arranged such that the leading edge of each sheet can smoothly pass over the gap formed between the stationary member and each of the transport members. This can be achieved by forming the edges of the stationary member and the transport member facing each other as toothed edges which may mesh with each other, so that the leading edge of the sheet will be supported on the teeth of both members. Preferably, the teeth should have a tapered shape, such as for instance a triangular or trapezoidal shape, which provides a sufficient play for the rotation of the transport member relative to the stationary member even when the teeth of these members are meshing.

BRIEF DESCRIPTION OF THE DRAWINGS

Preferred embodiments of the present invention will now be described in conjunction with the drawings, wherein.

DETAILED DESCRIPTION OF THE INVENTION

Figure 1:
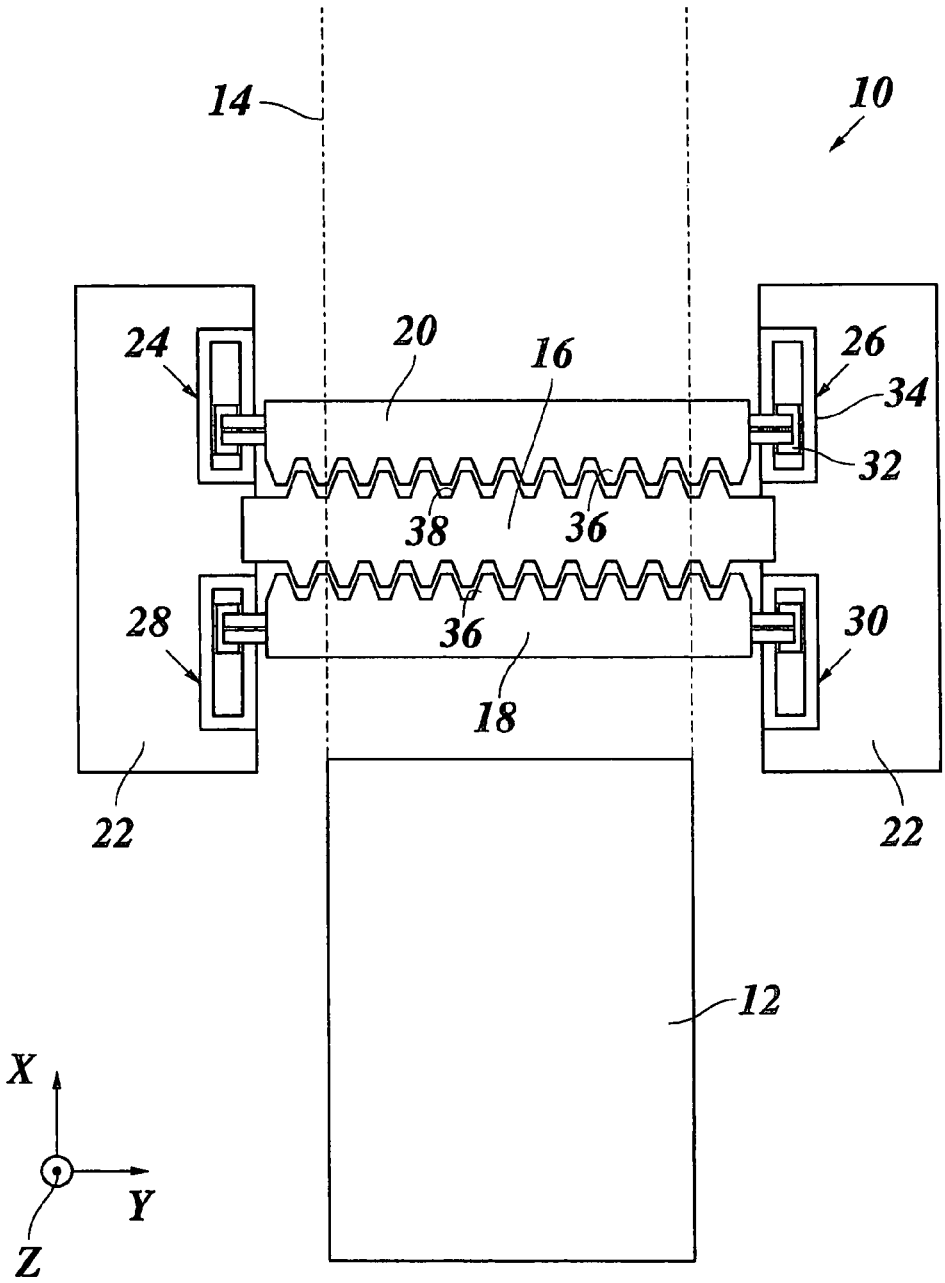
FIG. 1 is a schematic plan view of a stepper mechanism according to the invention.

As is shown in FIG. 1, a stepper mechanism 10 is used for transporting a substrate 12, a sheet in this example, along a transport path 14. The transport mechanism 10 comprises a stationary member 16, a first transport member 18 and a second transport member 20. These members extend widthwise across the transport path 14. In the example shown, the stationary member 16 is arranged between the two transport members 18, 20.

The stationary member 16 is supported on frames 22 that are disposed on either side of the transport path 14.

The left and right ends of both transport members 18, 20 are supported on the frames 22 via separate drive units 24, 26, 28 and 30. In the example shown, each drive unit comprises a slide 32 which supports one end of the transport member and is guided and driven in a stator 34 which, together with the slide 32, forms a linear displacement system. Thus, each slide 32 is movable in a transport direction X in parallel with the transport path 14, and its stroke can be programmed and controlled with high accuracy. The linear displacement system may further comprise a step motor, or a spindle, or any other suitable electro-mechanical drive mechanism or pneumatic drive mechanism and the like can be used. It is preferable that the strokes of all four drive units 24, 26, 28, 30 are independent from one another. In a modified embodiment, however, the drive units 24, 26 and 30 may be coupled mechanically or electronically, and only the drive unit 28 is independent from the others.

The edges of the transport members 18, 20 facing the stationary member 16 are formed with tapered teeth 36, and the stationary member 16 has teeth 38 complementary thereto. When a transport member is actively driven to transport the substrate, the teeth 36 of the transport member may mesh with the teeth 38 of the stationary member 16, however, in such a case the meshing is such that gaps are formed between the teeth of stationary member 16 and the teeth of the transport members 18, 20. Although the gap size may be very limited, the shape of the teeth permits the slight rotation of the transport member 18, 20 relative to the stationary member 16 about an axis extending in a direction Z normal to the plane X-Y of the transport path 14, while the teeth 36, 38 continue to overlap with each other in the X-direction. When the transport member is not actively driven, e.g., when a new substrate is fed to the stepper mechanism, the teeth 36, 38 may be designed such that they completely mesh, i.e., no gap is formed between the respective teeth of the transport member and the stationary member. An advantage thereof is that a new substrate can be transported smoothly towards the stepping mechanism as there are no exposed teeth edges. This improves the reliability of the substrate transport.

The operation of the stepper mechanism 10 will now be explained in conjunction with FIGS. 2 and 3.

Figure 2:
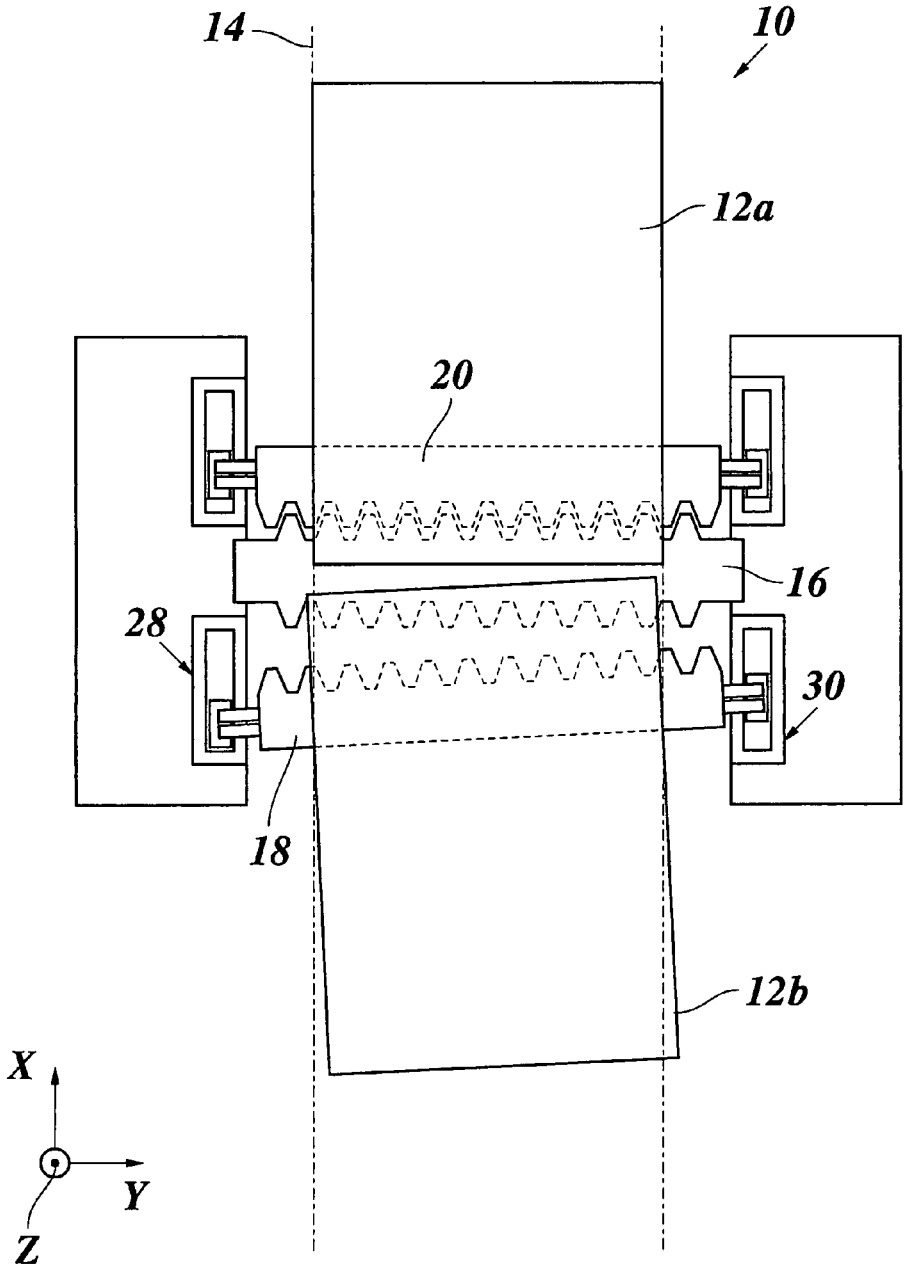
FIGS. 2 and 3 are plan views showing the stepper mechanism in different conditions.

In FIG. 2, the second transport member 20 is in a position close to the stationary member 16 and supports a trailing portion of a first substrate sheet 12*a*. The sheet 12*a* is gripped by the transport member 20 by means of vacuum suction, as will be explained later. A subsequent sheet 12*b* is fed to the stepper mechanism 10 by a feed mechanism that has not been shown such that the leading edge of sheet 12*b* is smoothly guided onto the stationary member 16 over the meshing teeth 36, 38. The leading edge of sheet 12*b* at least partially overlaps with the stationary member 16.

Then, the first transport member 18 is moved away from the stationary member 16 and grips the sheet 12*b*. As has been shown exaggeratedly in FIG. 2, the sheet 12*b* is supplied in a somewhat inclined or slanting position. The posture of the first transport member 18 is adapted to this inclination by controlling the drive unit 28 to perform a larger stroke than the drive unit 30.

Figure 3:
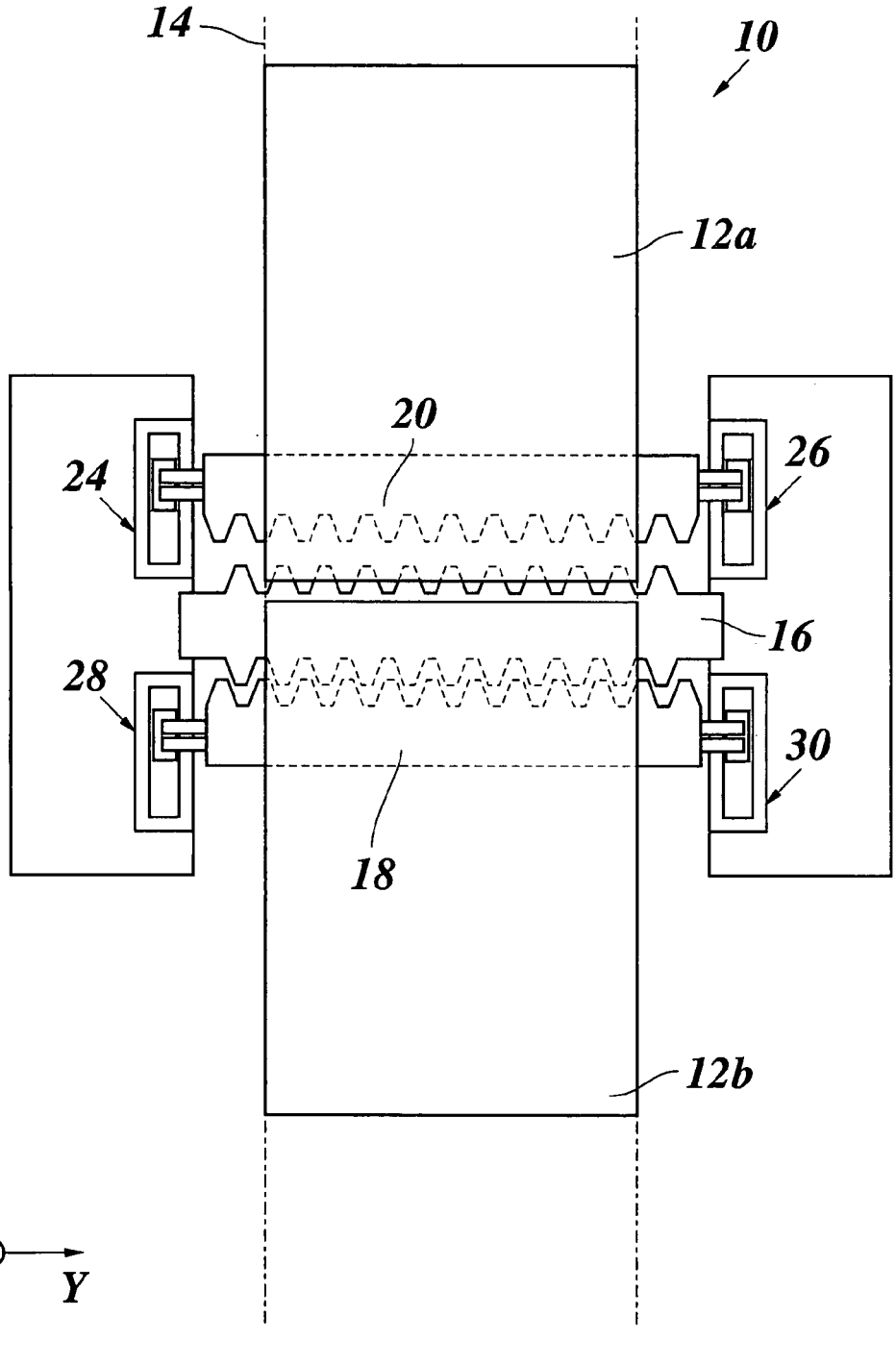

Then, as is shown in FIG. 3, all drive units 24-30 are controlled to move the transport members 18, 20 and the sheets 12*a*, 12*b* in positive X-direction. While the drive units 24, 26 and 30 perform strokes of equal length, the drive unit 28 performs a larger stroke, so that the sheet 12*b* is rotated and is then perfectly aligned with the transport path 14. In this context, it is important that the drive units 24 and 28 can be controlled independently from one another, so that only the sheet 12*b* will be rotated while the sheet 12*a*, which has the correct orientation already, will not be rotated but will be fed straight along the transport path 14.

In a next step, the transport members 18 and 20 will release the sheets 12*a* and 12*b*. The leading part of sheet 12*b* will be gripped by the stationary member 16, while the trailing part of sheet 12*b* may still be supported by the feed mechanism (not shown), The sheet 12*a* will be gripped by the stationary member 16 (because its trailing edge still overlaps the teeth thereof and/or by a discharge mechanism which has not been shown and which will engage the leading part of the sheet 12*a*. In a practical embodiment, the discharge mechanism may be a second stepper mechanism having the same construction as the shown stepper mechanism 10. Then, while the sheets are held stationary, the transport members 18 and 20 will be moved back into positions similar to those shown in FIG. 2. This time, however, the drive unit 28 will perform the same stroke as the other drive units, so that the first transport member 18 will be moved without rotation.

Subsequently, the sheets 12*a* and 12*b* are gripped again by the transport members 18, 20 and are moved a further step in a positive X-direction. In the subsequent operation cycles, the sheet 12*a* will be taken-over by the discharge mechanism, and the sheet 12*b* will intermittently be gripped and held by the stationary member 16 in the phases when the transport members 18, 20 move in the negative X-direction.

Figure 4:
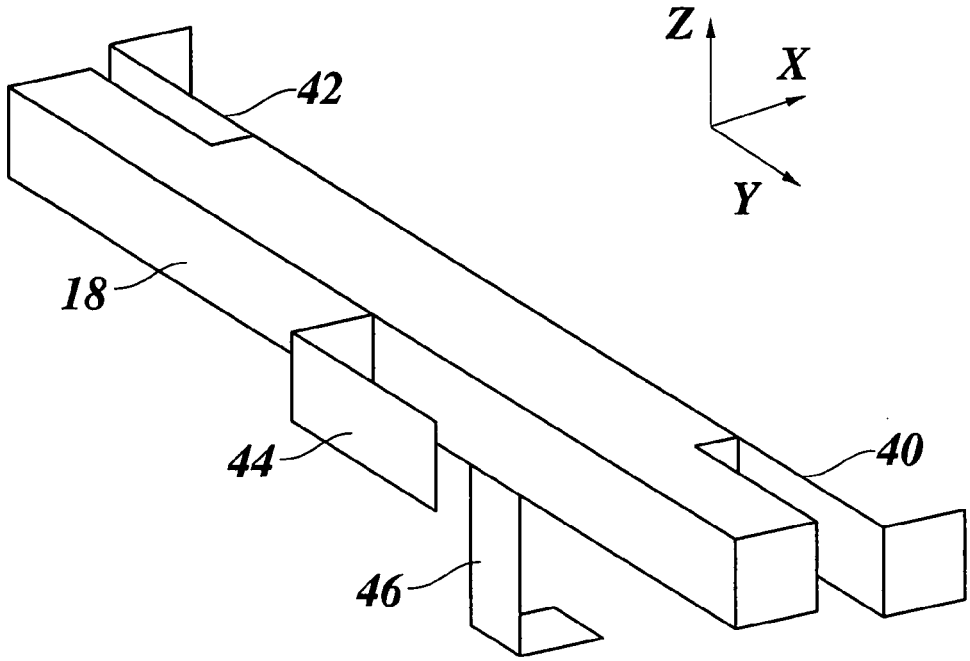
FIG. 4 is a schematic perspective view of a suspension system for a transport member.

FIG. 4 schematically illustrates an embodiment of a suspension system for movably mounting the transport members, e.g., the first transport member 18 on the frames 22. The transport member 18, which has simply been shown as a bar in this drawing, has in the following degrees of freedom: translations Tx, Ty and Tz, in the directions X, Y, Z, respectively, and rotations Rx, Ry and Rz about the axes X, Y and Z, respectively. The transport member 18 is suspended by four leaf springs 40, 42, 44 and 46 which are connected to the transport member and have the respective free ends rigidly connected to the frames 22 which are not shown in FIG. 4. The leaf springs 40 and 42 are connected to the opposite ends of the transport member 18 and fix the same in the degrees of freedom Tz and Rx. The leaf spring 44 fixes the transport member in the degree of freedom Ry, and the leaf spring 46 fixes the transport member in the degree of freedom Ty. Thus, the remaining degrees of freedom Tx and Rz enable the transport member to perform the movements that have been described in conjunction with FIGS. 2 and 3. The leaf springs 40, 42, 44 permit these movements but hold the transport member in a position in which its top surface is exactly flush with the top surface of the stationary member 16. Leaf spring 46 determines the direction of movement.

Figure 5:
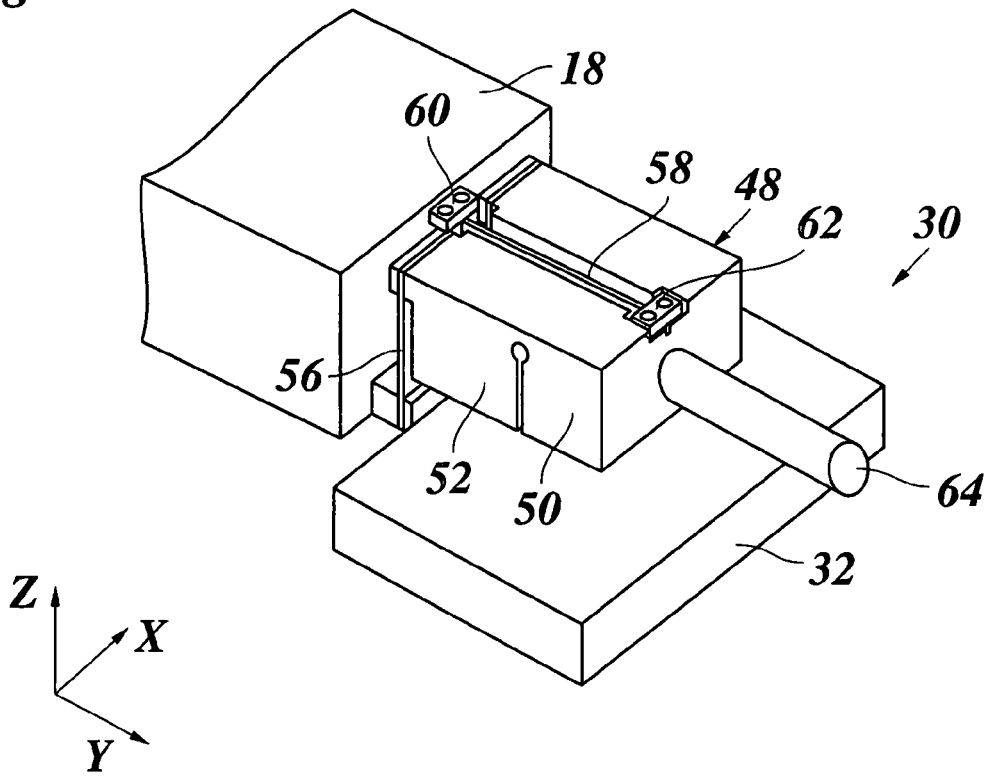
FIG. 5 is a perspective view of the suspension mechanism for one end of the transport member, according to a modified embodiment.

FIG. 5 illustrates another embodiment of a suspension system wherein one end of the transport member 18 (or 20) is connected to the associated drive unit 30 (or 26) shown in FIG. 1. A hinge block 48 has a first hinge portion 50 rigidly mounted on the slide 32. A second hinge portion 52 projects towards the end of the transport member 18 but does not engage the same. The transport member is suspended on the hinge portion 52 by means of a vertically extending leaf spring 56 which is free to flex in positive or negative Y-direction. Moreover, a link 58 has one end fixed to a bracket 60 that is mounted on the transport member 18 and an opposite end fixed in a bracket 62 that is mounted on the first hinge portion 50. The link 58 is level with the hinge axis between the hinge portions 50 and 52. An adjusting screw 64 permits to deflect the hinge portion 52 of the hinge block 48 for fine-adjustment of the height of the transport member 18.

A construction similar to the one shown in FIG. 5 is provided at the other end of the transport member (not shown) except that no link 58 is provided which means that Ry and Ty are not fixed at that end.

Figure 6:
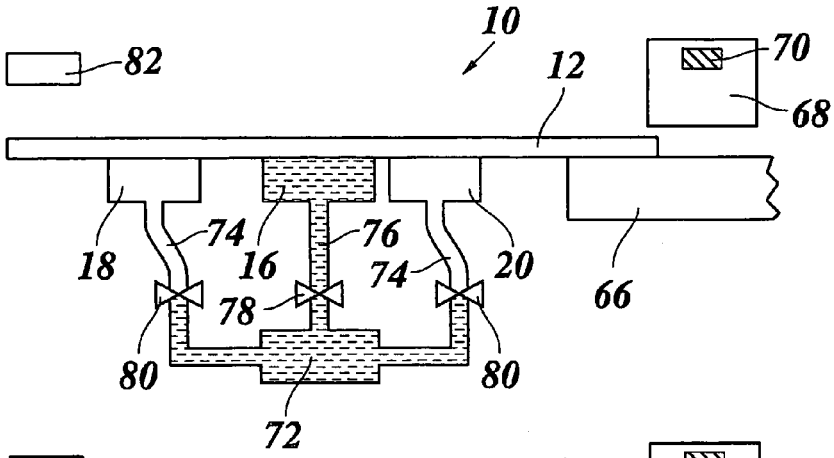
FIGS. 6 to 9 are schematic cross-sectional view of a stepper mechanism in an ink jet printer.

FIG. 6 is a schematic cross-sectional view in the transport direction of the stepper mechanism 10 integrated in an ink jet printer having a print surface 66 which supports the substrate 12 on a part of its transport path. A printhead 68 is mounted above the print surface 66 and is movable along a guide rail 70 that extends across the transport path, so that the printhead may scan a portion of the substrate 12 supported on the print surface 66 and may print a swath of an image on the top surface of the substrate. When the swath has been printed, the stepper mechanism 10 is used to advance the substrate 12 by an exactly specified distance, so that a subsequent swath can be printed exactly adjacent to the first one. For obtaining a good image quality, the accuracy in the length of the advance steps must be in the order of several μm.

The substrate 12 may be a large format sheet (e.g., A0), so that the printer and the stepper mechanism have considerable dimensions. In order to achieve a high productivity, the length of the advance step should be sufficiently large, typically in the order of tens of millimeters while the time required for executing a single advance step should be sufficiently small, typically well below 0.5 s. This implies that the substrate 12 is subjected to significant acceleration, deceleration forces during advancement. As a consequence, the transport members 18, 20 and the stationary member 16 must be capable of gripping the substrate 12 with a sufficient force.

This may be achieved by means of a vacuum system. The stationary member 16 and the transport members 18, 20 are configured as chambers having perforated top surfaces supporting the substrate 12. These chambers are connected to a plenum chamber 72, in which a vacuum is maintained. The transport members 18, 20 are connected to the plenum chamber 72 through flexible tubes 74, while a rigid pipe 76 may be used for the stationary member 16. The pipe 76 and the tubes 74 contain valves 78 and 80, respectively, for controlling the intermittent supply of vacuum to the stationary member 16 and the transport members 18, 20.

Figure 10:
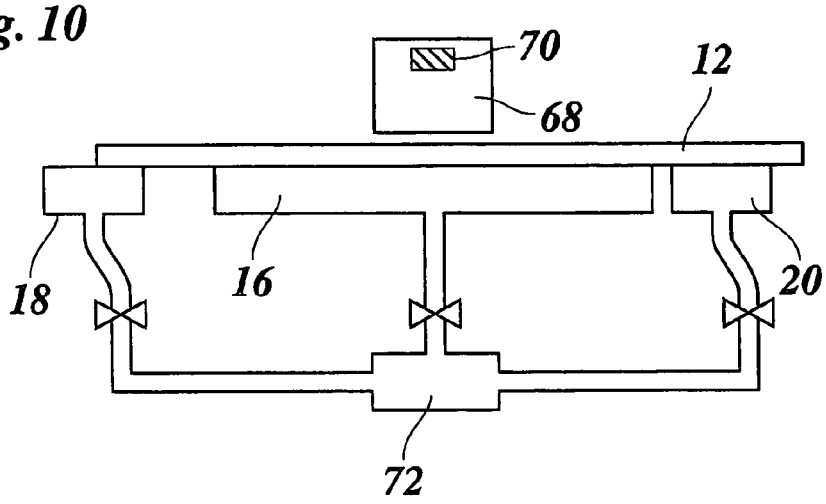
FIG. 10 is a schematic cross-sectional view of a stepper mechanism in an ink jet printer according to a modified embodiment.

In the example shown, the stepper mechanism 10 is arranged upstream of the print surface 66. Alternatively, the stepper mechanism may be provided downstream of the print surface 66, or two stepper mechanism may be provided upstream and downstream thereof. Preferably, however, a stepper mechanism is positioned such that the surface of the stationary member constitutes the print surface as illustrated in FIG. 10. The stationary member 16 and the transport members 18, 20 are flush with the print surface 66, so that the substrate 12 is smoothly fed onto the print surface. Optionally, the edges of the print surface 66 and the transport member 20 facing each other may be provided with teeth similar to the teeth 36 and 38 shown in FIG. 1.

A position detector 82, such as e.g., an optical sensor, may be disposed above the transport path on the upstream side of the stepper mechanism 10 for detecting a possible inclination of the sheet and also a possible positional deviation of the sheet in the direction Y normal to the transport direction X and/or a positional deviation in the X direction. Such a positional deviation in the Y-direction cannot be corrected with the mechanism shown in FIGS. 1 to 3, but may be compensated for by appropriately adjusting the timing at which the printhead 68 is operated during the scan movement.

In the condition shown in FIG. 6, the valve 78 is open while the valves 80 are closed, so that the transport members 18 and 20 release the substrate 12, and the substrate is sucked against the surface of the stationary member 16.

Figure 7:
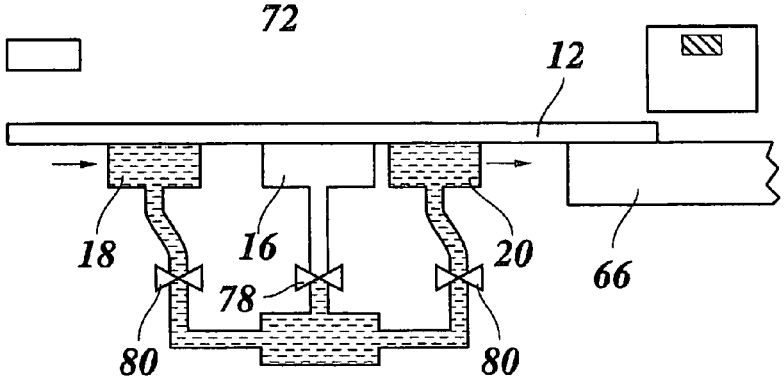
Figure 8:
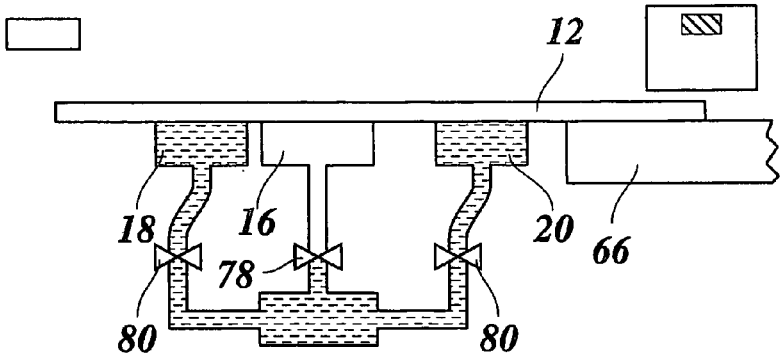
Figure 9:
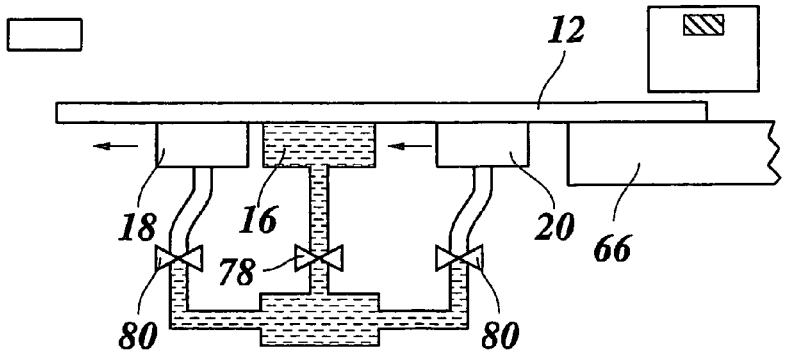

In order to advance the substrate 12, the valve 78 is closed and the valves 80 are opened, so that vacuum is now applied to the transport members 18 and 20, as is shown in FIG. 7. Thus, the substrate 12 will be released by the stationary member 16 but will be firmly gripped through vacuum pressure by the transport members 18 and 20. These transport members are then moved towards the print surface 66, so as to advance the substrate 12 into the position shown in FIG. 8. Then, as is shown in FIG. 9, the valves 80 are closed again and the valve 78 is opened, so that the substrate 12 is gripped in the new position by the stationary member 16, and the transport members 18 and 20 are returned into the position shown in FIG. 6 so that a new cycle may commence.

If necessary, especially when a new sheet is being supplied, the transport member 18 will not only be moved in the transport direction but will also be rotated as has been described in conjunction with FIGS. 2 and 3.

Figure 11:
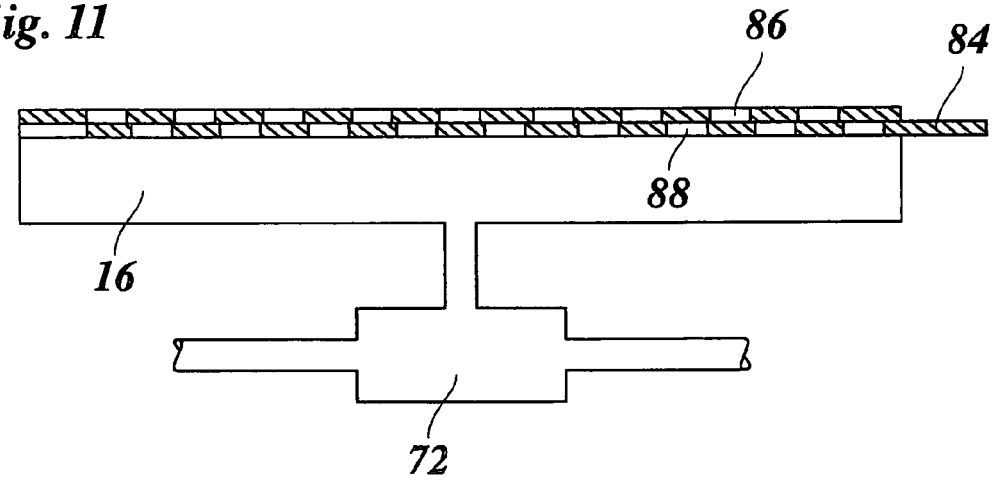
FIGS. 11 and 12 are schematic views showing different operating states of a stationary member of a stepper mechanism according to another embodiment.
Figure 12:
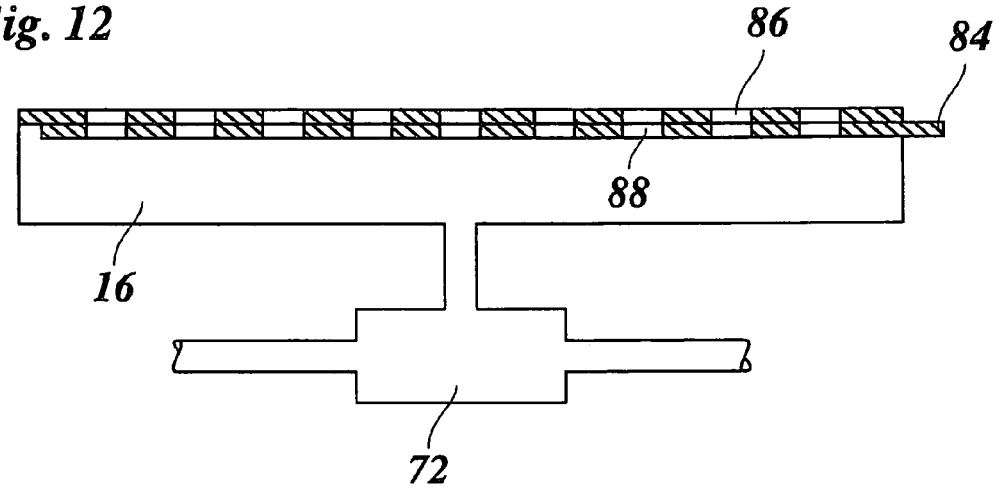

FIGS. 11 and 12 schematically depict the stationary member 16 of a stepper mechanism according to yet another embodiment, wherein the valves 78 and 80 have been replaced by gate valves 84. A top wall of the stationary member 16 has been shown in cross-section, so that perforations 86 thereof are visible. The gate valve 84 is formed by a sliding plate that has a corresponding pattern of perforations 88. In FIG. 11, the gate valve 84 assumes a position in which the perforations 86 are blocked, so that, although the stationary member is constantly connected to the vacuum in the plenum chamber 72, no air will penetrate in, i.e., the substrate 12 would be released. In FIG. 12, the gate valve 84 has been shifted to a position where the perforations 88 coincide with the perforations 86, so that air will be drawn in and the substrate will be gripped. This embodiment has the advantage that the substrate can be gripped and released faster, because no time is needed for building up a vacuum in the stationary member 16. It goes without saying that similar gate valves may also be provided for the transport members 18, 20 which are not shown in FIGS. 11 and 12.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim.

What is claimed is:

1. A stepper mechanism for transporting a substrate along a linear transport path, comprising a stationary member, first and second transport members extending widthwise across the transport path, said stationary member and transport members each being adapted to alternatively grip and release the substrate, and independent drive units arranged on either side of the transport path for moving respective ends of the transport members in a transport direction (X), wherein the transport members move independently of one another, and at least one of the drive units moves one end of the transport member independently from the drive unit on the opposite end of the same transport member, thereby providing the ability to rotate a substrate gripped by the transport member in a plane of the substrate that is in the same plane as the transport path.

2. The stepper mechanism according to claim 1, wherein the stationary member and at least one of the transport members have teeth that mesh with each other at least in a position where the transport member is in close proximity to the stationary member.

3. The stepper mechanism according to claim 2, wherein the teeth have tapered shapes.

4. The stepper mechanism according to claim 1, wherein the stationary member and the transport members are configured as suction chambers that are connectable to a vacuum source and have perforations in their top walls for gripping the substrate through vacuum pressure.

5. The stepper mechanism according to claim 4, wherein at least one of the stationary member and the transport members is provided with a gate valve for selectively blocking or opening the perforations in its top wall.

6. The stepper mechanism according to claim 1, comprising a detector for detecting an angle of inclination of a substrate sheet supplied to or transported by the stepper mechanism, and wherein the drive units are controlled in accordance with the angle of inclination detected by said detector.

7. The stepper mechanism according to claim 1, wherein said stepper mechanism is provided on the upstream side or the downstream side of a print surface.

8. The stepper mechanism of claim 7, wherein the independent drive units also provide non-rotational displacement of the transport members relative to the transport direction.

* * * * *

UNITED STATES PATENT AND TRADEMARK OFFICE

CERTIFICATE OF CORRECTION

PATENT NO. : 7,823,880 B2
APPLICATION NO. : 11/808197
DATED : November 2, 2010
INVENTOR(S) : Jeroen J. G. Coenen et al.

It is certified that error appears in the above-identified patent and that said Letters Patent is hereby corrected as shown below:

ON THE TITLE PAGE:

At item (75), correct the Inventors to read:

-- Jeroen J. G. Coenen, Sevenum (NL); Bas W. J. J. A. Van Dorp, Eindhoven (NL) --.

Signed and Sealed this
First Day of February, 2011

David J. Kappos

David J. Kappos
*Director of the United States Patent and Trademark Office*